US006394678B2

(12) United States Patent
Schrepf

(10) Patent No.: US 6,394,678 B2
(45) Date of Patent: May 28, 2002

(54) ZONED MASCARA BRUSH AND PACKAGE INCLUDING THE BRUSH

(75) Inventor: Volker Schrepf, East Islip, NY (US)

(73) Assignee: Henlopen Manufacturing Co., Inc., Melville, NY (US)

( * ) Notice: Subject to any disclaimer, the term of this patent is extended or adjusted under 35 U.S.C. 154(b) by 0 days.

(21) Appl. No.: 09/788,749

(22) Filed: Feb. 20, 2001

Related U.S. Application Data

(60) Provisional application No. 60/183,851, filed on Feb. 22, 2000, and provisional application No. 60/191,377, filed on Mar. 22, 2000.

(51) Int. Cl.[7] ..... A46B 11/00

(52) U.S. Cl. ..... 401/126; 401/129; 401/130; 15/207; 15/207.2; 15/114

(58) Field of Search ..... 401/126, 129, 401/130, 121; 15/207.2, 207, 206, 114

(56) References Cited

U.S. PATENT DOCUMENTS

| | | | | |
|---|---|---|---|---|
| 2,303,660 A | | 12/1942 | Schickel | 15/114 |
| 3,186,019 A | * | 6/1965 | Hattori | 15/207.2 |
| 4,861,179 A | | 8/1989 | Schrepf et al. | 401/129 |
| 5,345,644 A | | 9/1994 | Gueret | 15/160 |
| 5,482,059 A | | 1/1996 | Miraglia | 132/218 |
| 5,490,529 A | | 2/1996 | Fitjer | 132/218 |
| 5,839,146 A | | 11/1998 | Chen | 15/114 |
| 5,876,138 A | | 3/1999 | Gueret | 401/129 |

* cited by examiner

*Primary Examiner*—David J. Walczak
(74) *Attorney, Agent, or Firm*—Cooper & Dunham LLP

(57) ABSTRACT

A twisted-in-wire mascara brush constituted of one or more zones of mascara-absorptive material such as cotton fibers or polymeric sponge material alternating with one or more zones of bristles or fibers substantially nonabsorptive to mascara along the length of the brush. A package of mascara includes a container holding a body of mascara and an applicator brush constituted of alternating zones of material absorptive to the mascara and bristles or fibers nonabsorptive to the mascara.

17 Claims, 2 Drawing Sheets

ZONED MASCARA BRUSH AND PACKAGE INCLUDING THE BRUSH

CROSS REFERENCE TO RELATED APPLICATIONS

This application claims the priority benefit, under 35 U.S.C. §119(e), of applicant's U.S. Provisional Application No. 60/183,851, filed Feb. 22, 2000, and No. 60/191,377, filed Mar. 22, 2000, the disclosures of both of which are incorporated herein in their entirety by this reference.

BACKGROUND OF THE INVENTION

This invention relates to brushes for applying mascara or the like, and to packages of mascara including the brushes.

For purposes of illustration, the invention will be described as embodied in mascara brushes of the type having an axially elongated twisted wire core with a multiplicity of fibers such as bristles clamped at their midpoints in the core and extending radially outwardly therefrom. The core is constituted of two lengths of wire, which may be initially separate or may be opposed legs of a single U-shaped wire, twisted together into a helix to hold the bristles between them. Such mascara brushes are well known and widely used in the cosmetics industry.

The combination of a twisted wire core and a radiating array of bristles clamped in the core provides a simple and effective brush structure for uses exemplified by the application of mascara. It is frequently found, however, that a conventional brush wherein the constituent fibers are uniform from end to end is not wholly satisfactory for performing the two different functions of, first, applying (delivering and depositing) mascara onto the eyelashes, and thereafter combing the mascara through the eyelashes.

SUMMARY OF THE INVENTION

An object of the invention is to provide a mascara brush affording, in a unitary device, superior properties for performing both of the sequential functions of applying mascara and combing lashes. Another object is to provide a mascara package incorporating, in combination with a contained body of mascara, a brush affording superior properties for applying as well as combing the mascara formulation contained in the package.

To these and other ends, the present invention, in a first aspect, broadly contemplates the provision of a brush for applying mascara, comprising an axially elongated twisted wire core having a proximal end and a distal end and a length therebetween, and a brush body projecting outwardly around the core over a substantial part of the length of the core, wherein the brush body comprises at least one zone of fibers for combing eyelashes and substantially nonabsorptive to mascara, and at least one zone of material substantially absorptive to mascara, these nonabsorptive and absorptive zones being disposed in alternating succession along the length of the core.

As a further feature of the invention, in particular embodiments thereof, the zone (or one of the zones) of substantially nonabsorptive fibers is closer to the distal end of the core than is any of the zones of substantially absorptive material.

In certain embodiments, the brush body comprises a plurality of the zones of fibers for combing eyelashes and substantially nonabsorptive to mascara, and a plurality of the zones of material substantially absorptive to mascara, these nonabsorptive and absorptive zones being disposed in alternating succession along the length of the core. A currently preferred arrangement includes three zones of the substantially absorptive material and four zones of the substantially nonabsorptive fibers.

The substantially nonabsorptive fibers, which perform the combing function, are conveniently or preferably stiff hollow or solid synthetic (e.g. nylon) fibers clamped in the core and extending radially therefrom. The substantially absorptive material, which performs the transport and delivery function, may comprise absorptive fibers, e.g. cotton fibers, also clamped in the core and extending radially therefrom. Alternatively, the substantially absorptive material may comprise a polymeric sponge material clamped in the core in each of the plural zones of such material.

In a second aspect, the invention embraces a package of mascara, comprising a container for holding mascara and having a mouth; a body of mascara disposed in the container; a cap mountable on the mouth; and a brush carried by the cap so as to be immersible in the body of mascara within the container, the brush being as defined above and including a brush body which comprises a plurality of zones of fibers for combing eyelashes and substantially nonabsorptive to the mascara in the container, and a plurality of zones of material substantially absorptive to the mascara in the container, these nonabsorptive and absorptive zones being disposed in alternating succession along the length of the core.

Further features and advantages of the invention will be apparent from the detailed description hereinbelow set forth, together with the accompanying drawings.

DETAILED DESCRIPTION

Figure 1:
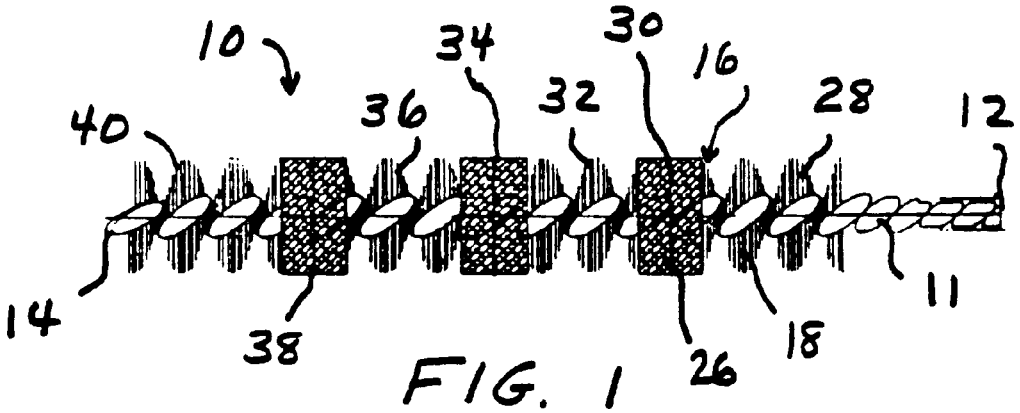
FIG. 1 is a side view of a brush embodying the invention in a particular form.

The present invention will be described with reference to FIGS. 1 and 2, for purposes of illustration, as embodied in a mascara brush 10 comprising an axially elongated twisted wire core 11 having a proximal end 12 and a distal end 14, and a brush body 16 including a multiplicity of stiff bristles or fibers 18 clamped in the core and extending radially therefrom to constitute a bristle array projecting outwardly around the core over a substantial part of the length of the core. The proximal portion of the core extends beyond the bristle array so as to be mountable in the stem 20 (FIG. 2) of a cap 22 of a mascara package 24.

By way of example, but without limitation, the stiff fibers 18 may be stiff hollow synthetic (e.g. nylon) fibers of the type described in U.S. Pat. No. 4,733,425, or stiff solid fibers. As in conventional brushes, the core 11 itself may be made by helically twisting two lengths of wire (or two opposed legs of a single U-shaped wire) while the fibers are held between the wires so as to be clamped, ordinarily at their midpoints, between the twisted wires of the core. The radiating free extremities of the fibers may define a cylindrical profile, as shown, or a profile tapering toward one or both of the distal and proximal ends of the brush, such profile being imparted by trimming the fiber (bristle) ends after the fibers are assembled with the core.

In the illustrated embodiment of the invention, as a particular feature thereof, the described array of bristles or fibers 18 is not continuous from end to end of the brush body, but is interrupted by three discrete and evenly spaced zones of material 26 highly absorptive to mascara. Thus, between the proximal and distal ends of the brush body, along the length of the core, there are disposed successive, alternating, contiguous zones of fibers 18 and mascara-absorptive material, viz., a proximal zone 28 of fibers 18, a first zone 30 of absorptive material 26, a second zone 32 of the fibers 18, a second zone 34 of the absorptive material, a third zone 36 of the fibers 18, a third zone 38 of the absorptive material, and a fourth zone 40 of the fibers 18, the zone 40 extending to the distal extremity of the brush.

The absorptive material 26 may illustratively be soft cotton fibers, densely aggregated together in each of the zones 30, 34 and 38 (i.e., having a substantially higher density or number of fibers per turn of the core wire than the number of fibers 18 in the zones 28, 32, 36 and 40). Unlike the nylon fibers 18, the cotton fibers are solid (not hollow). They may be clamped at their midpoints between the twisted wires of the core 11, in each of the three zones 30, 34 and 38, so that they have opposed free ends.

Alternatively, the absorptive material 26 may be a mascara absorptive porous polymer sponge strip, clamped along its major axis between the twisted wires of the core 11 forming a tight spiral in surrounding relation thereto to constitute each of the zones 30, 34 and 38 after the bristles have been mounted in the core.

The fibers 18, in either instance, are relatively stiff so as to be able to comb mascara (delivered to the eyelashes by the zones of absorbent material) through the lashes. They are very significantly more stiff than the cotton fibers, for example, when the latter are employed to constitute the absorbent material.

In an illustrative but non-limiting specific example of a brush according to the present invention, the bristles 18 are hollow nylon fibers having a diameter of 0.006±0.0005 inch, and the absorptive material is constituted of (solid) cotton fibers. The profile of the brush is cylindrical from end to end of the brush body, with a cross-sectional diameter of 0.180 inch and a length of 1-⅛ inch. The wire is stainless steel type 305 wire, with a diameter of 0.0286 inch, and is twisted so that the brush body occupies about 15 turns or coils, ± one turn. The three zones of cotton fibers (which are trimmed to the same 0.180 inch diameter as the zones of hollow nylon fibers) are spaced 0.270 inch apart on midpoints; the axial dimension from the midpoint of the third zone 38 of cotton fibers to the distal end of the core is 0.325 inch, while the distance from the proximal end of the brush body to the midpoint of the first zone 30 of cotton fibers is 0.270 inch. The total count of hollow nylon fibers 18, from end to end of the brush, is 640±45. The proximal extremity of the core extends for ¼ inch beyond the brush body, and is coined, for mounting in the stem 20 of a cap 22.

The brush exemplified by the foregoing dimensions is smaller in diameter than a conventional mascara brush. Because the absorbed mascara density in the cotton or sponge zones is greater than in a conventional mascara brush, the total volume of the brush can be reduced proportionately.

Three evenly spaced zones of soft (absorptive) material are included in the above-described brush. Because eyelashes are radially extended along a great circle from the spherical eyelid, only tangential contact between the brush and eyelashes is possible. The number and lengths of the zones can be selected empirically to allow the user to select with minimum lateral motion a convenient tangent point with which to perform either the application or comb functions.

Figure 2:
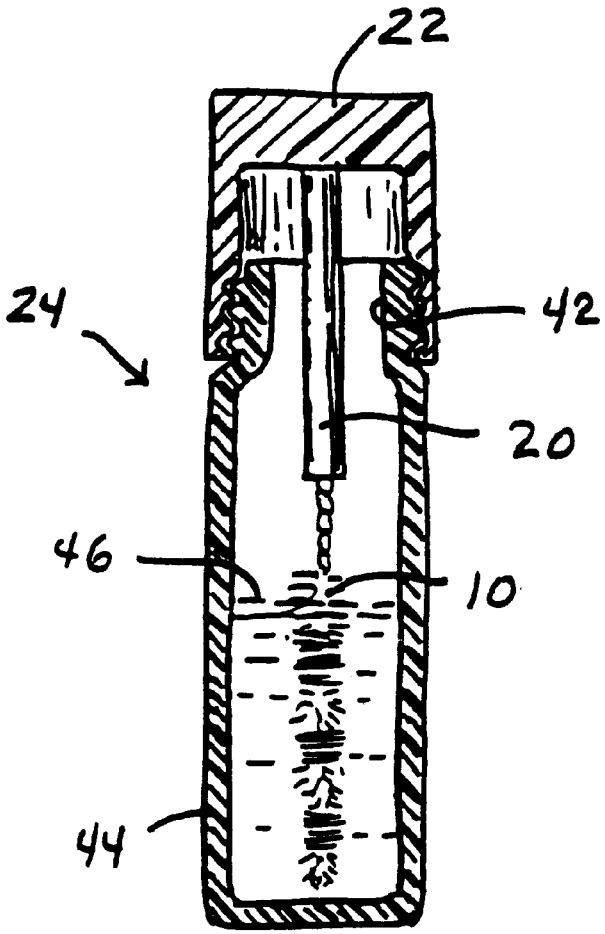
FIG. 2 is a simplified schematic view of a mascara package incorporating the brush of FIG. 1.

As best seen in FIG. 2, the cap carrying such a brush fits threadedly on the neck 42 of a container 44 for holding a body of liquid or flowable mascara 46 such that when the cap is threaded on the neck, the stem projects through the container mouth defined by the neck and into the interior of the container, and the brush is immersed in the body of mascara 46. The container may, by way of non-limiting example, be an axially elongated, generally cylindrical, substantially rigid element (e.g. a unitary molded plastic container). The mascara of the body 46 may be of low, medium, or high viscosity. The cap, which (with its associated stem) may also conveniently be a substantially rigid molded plastic element, serves both to close the container when threaded on the neck and to provide a handle for manipulation of the brush 10.

In use, the cap is grasped manually, unscrewed and withdrawn from the neck, carrying the brush 10 out of the body of mascara and out of the container. A quantity of mascara is picked up on the brush, in particular by the absorbent zones 30, 34 and 38, and transported out of the container on the latter zones of the brush for application to the user's eyelashes. In practice, a flexible wiper element (not shown), e.g. of conventional structure, is mounted in the neck to engage and wipe excess mascara from the brush as the brush is extracted outwardly therethrough.

The user, still holding the cap, next applies mascara from the absorbent zones to the eyelashes, and then combs the applied mascara through the lashes, using for that purpose the relatively stiff nonabsorbent bristles or fibers of the zones 28, 32, 36 and 40. Thereafter the brush is returned to the container, either to pick up additional mascara for application, or, if application is complete, to close the container by threading the cap on the neck.

The beneficial functions and advantages of the brush and package of the invention may now be readily understood. The brush, in various embodiments, is capable of carrying low and high viscosity mascara formulations and having the ability to simultaneously apply mascara to, and comb, the receiving eyelashes. 'Comb' is defined as removing excessive formula to the individual user's taste and separating the eyelashes. This is accomplished by zone deployment of dense high absorbency fibers or a polymeric sponge material alternating with a relatively dispersed nonabsorbent fibers zone. When used with a low viscosity formulation, immersion of the brush into low viscosity mascara formula causes the high absorbency zones to absorb the formula while adhesion of the formula to the nonabsorbent fibers is minimal. The zoning configuration is such that a non-absorbing zone is located at the tip (distal) end of the brush. This is to allow for minimal application of formula to the eyelashes adjacent to the nasal area while allowing for lash separation. Most of the formula is applied to the mid and outside lashes. This pattern of mascara application is the accepted norm in the cosmetics industry.

When the brush is used with a high viscosity formula, the absorption of formula in the high absorbency zones can be adjusted in the manufacture by varying the density of the absorbent fibers or varying the sponge cell structure and/or size. This adjustment can be made so that the brush can carry a viscous mascara formula and perform in a manner parallel to the low viscosity application.

Thus, in short, the absorbency of the material constituting the absorptive zones 30, 34 and 38 may be selected to have appropriately high absorbency for the particular viscosity of the mascara of the body 46 in the container; i.e., in the combination of mascara, container and brush embodying the complete package of the invention, the material of the absorptive zones is chosen to be absorptive to mascara of the viscosity selected to fill the container.

Figure 3:
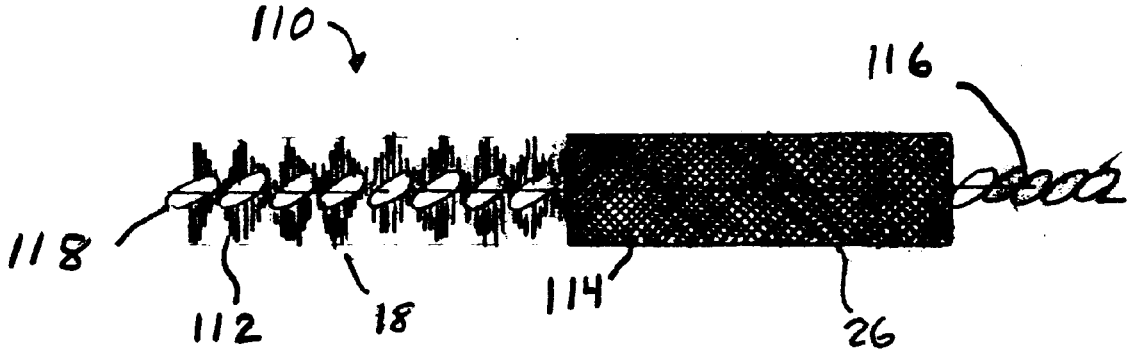
FIG. 3 is a view similar to FIG. 1 of another embodiment of the brush of the invention.

The mascara brush 110 in the embodiment of FIG. 3 differs from that of FIG. 1 in having a single zone 112 of the relatively stiff mascara-combing fibers 18 and a single zone 114 of the mascara-absorptive material 26, disposed in succession along a twisted-wire core 116 with the zone 112 of stiff fibers at the distal end 118 of the brush, for the same reason (explained above) that the distal zone of the brush of FIG. 1 is a zone of stiff, substantially nonabsorptive fibers. The zones 112 and 114 may be respectively the same, in structure, composition, mounting, arrangement and function, as one of the zones of fibers 18 and one of the zones of absorptive material 26 (which may, for example but without limitation, be cotton fibers or a mascara absorptive porous polymer sponge strip) in the brush of FIG. 1. The brush of FIG. 3 may be provided in place of the brush of FIG. 1, in the package of FIG. 2, and is used in the same way.

It is to be understood that the invention is not limited to the features and embodiments hereinabove specifically set forth but may be carried out in other ways without departure from its spirit.

What is claimed is:

1. A brush for applying mascara, comprising an axially elongated twisted wire core having a proximal end and a distal end and a length therebetween, and a brush body projecting outwardly around the core over a substantial part of the length of the core, wherein the brush body comprises (i) at least one zone of fibers for combing eyelashes and substantially nonabsorptive to mascara, and (ii) at least one zone of material substantially absorptive to mascara, said zones (i) and (ii) being disposed in succession along the length of the core.

2. A brush as defined in claim 1, wherein said one zone of substantially nonabsorptive fibers is closer to the distal end of the core than is any of the zones of substantially absorptive material.

3. A brush as defined in claim 2, having three zones of said substantially adsorptive material and four zones of said substantially nonadsorptive fibers, said zones of substantially adsorptive materials and said zones of substantially nonadsorptive fibers being disposed in alternating succession along the length of the core.

4. A brush as defined in claim 1, wherein the brush body comprises a plurality of said zones of fibers for combing eyelashes and substantially nonabsorptive to mascara, and a plurality of said zones of material substantially absorptive to mascara, said substantially nonabsorptive and substantially absorptive zones being disposed in alternating succession along the length of the core.

5. A brush as defined in claim 4, wherein one of the zones of substantially nonabsorptive fibers is closer to the distal end of the core than is any of the zones of substantially absorptive material.

6. A brush as defined in claim 1, wherein said substantially nonabsorptive fibers are stiff hollow or solid fibers clamped in the core and extending radially therefrom.

7. A brush as defined in claim 1, wherein said substantially absorptive material comprises absorptive fibers clamped in the core and extending radially therefrom.

8. A brush as defined in claim 7, wherein said absorptive fibers are cotton fibers.

9. A brush as defined in claim 8, having three zones of said absorptive fibers and four zones of said substantially nonabsorptive fibers, and wherein said substantially nonabsorptive fibers are stiff hollow or solid fibers clamped in the core and extending radially therefrom, said zone of adsorptive fibers and said zones of substantially nonadsorptive fibers being disposed in alternating succession along the length of the core.

10. A brush as defined in claim 1, wherein said substantially absorptive material comprises a polymeric sponge material secured to said core.

11. A brush as defined in claim 10, having three zones of said polymeric sponge material and four zones of said substantially nonabsorptive fibers, and wherein said substantially nonabsorptive fibers are stiff hollow or solid fibers clamped in the core and extending radially therefrom, said zones of polymeric sponge material and said zones of substantially nonadsorptive fibers being disposed in alternating succession along the length of the core.

12. A package of mascara, comprising:

(a) a container for holding mascara and having a mouth;

(b) a body of mascara disposed in the container;

(c) a cap mountable on the mouth; and (d) a brush carried by the cap so as to be immersible in the body of mascara within the container, said brush comprising an axially elongated twisted wire core having a proximal end and a distal end and a length therebetween, and a brush body projecting outwardly around the core over a substantial part of the length of the core, wherein the brush body comprises (i) at least one zone of fibers for combing eyelashes and substantially nonabsorptive to the mascara in the container, and (ii) at least one zone of material substantially absorptive to the mascara in the container, said zones (i) and (ii) being disposed in succession along the length of the core.

13. A package as defined in claim 12, wherein said substantially absorptive material comprises absorptive fibers clamped in the core and extending radially therefrom.

14. A package as defined in claim 13, wherein said absorptive fibers are cotton fibers.

15. A package as defined in claim 14, having three zones of said absorptive fibers and four zones of said substantially nonabsorptive fibers, and wherein said substantially nonabsorptive fibers are stiff hollow or solid fibers clamped in the core and extending radially therefrom, said zones of adsorptive fibers and said zones of subtstantially nonabsorptive fibers being disposed in alternating succession along the length of the core.

16. A package as defined in claim 12, wherein said substantially absorptive material comprises a polymeric sponge material secured to said core.

17. A package as defined in claim 16, having three zones of said polymeric sponge material and four zones of said substantially nonabsorptive fibers, and wherein said substantially nonabsorptive fibers are stiff hollow or solid fibers clamped in the core and extending radially therefrom, said zones of polymeric sponge material and said zones of substantially nonabsorptive fibers being disposed in alternating succession along the length of the core.

* * * * *